United States Patent [19]

Lewis

[11] 4,454,990

[45] Jun. 19, 1984

[54] PRESSURE COMPENSATED FUEL INJECTOR

[75] Inventor: Donald J. Lewis, Birmingham, Mich.

[73] Assignee: The Bendix Corporation, Southfield, Mich.

[21] Appl. No.: 430,191

[22] Filed: Sep. 30, 1982

[51] Int. Cl.[3] ..... B05B 1/30

[52] U.S. Cl. ..... 239/585; 251/141

[58] Field of Search ..... 239/585; 251/139, 141

[56] References Cited

U.S. PATENT DOCUMENTS 3,967,597 7/1976 Schlagmüller et al. ..... 239/585 X 4,403,741 9/1983 Moriya et al. ..... 239/585

*Primary Examiner*—John J. Love

*Assistant Examiner*—Mary McCarthy

*Attorney, Agent, or Firm*—Russel C. Wells; Markell Seitzman

[57] ABSTRACT

A fuel injector (10) is fabricated from powdered metal or sintered iron technology and is modified to respond to variations in fuel pressure to maintain the flow output from the injector constant for a given pulse width regardless of the pressure of the source of fuel. Modifications are directed to variable lift of the valve member (30) from the valve seat (48), variable pressure applied to the valve member (30) to hold the valve member on the valve seat (48) and an injector having the features of both variable lift and variable pressure.

4 Claims, 9 Drawing Figures

PRESSURE COMPENSATED FUEL INJECTOR

This invention relates to fuel injectors in general and in particular to fuel injectors wherein the pressure of the fuel is used to maintain the flow rate of the injector.

In prior art fuel injectors such as that shown in U.S. Pat. Nos. 4,254,653, 4,235,375 and 4,232,830 all assigned to the same assignee of this invention, the pressure of the fuel supply is regulated externally to the injector and the flow rate of the injector is not modified in accordance with variations in fuel pressure. Therefore, across the pressure range of the fuel pressure regulator, the amount of fuel discharged from the injector for a given electrical pulse width will vary with variation in pressure.

In low pressure fuel supplies wherein the above identified injectors are used, the pressure of the fuel ranges between 9 and 15 psi, and this variation does not materially affect the flow rate. In engines powered by liquid propane gas (LPG), the gas, in its liquified state, is maintained at a pressure of 100 to 150 psi and when pressure of LPG is reduced, it changes from a liquified state to a gaseous state. With such a variation in pressure, the amount of fuel discharged from the injector for a given electrical pulse width will vary directly with fuel pressure.

In the injector there are two adjustments; static and dynamic. The static adjustment determined the "lift" of the ball valve from the seat to allow a given flow rate from the injector. This rate may be measured in "CC per sec". This adjustment, in prior art injectors, is made by supplying fuel at a given pressure to the injector, powering the coil to "lift" the valve whereby the core seats against the pole piece and adjusting the seat (axially) until the desired amount of fluid is flowing from the valve. This will then give, at a given pressure value, a set of predetermined flow rates.

If the pressure changes from the given value, it is seen that the flow rate then changes. Hence, it is another object of this invention to provide an automatic adjustment of the lift or opening of the valve as a function of the pressure of the fluid in order to assist in maintaining the desired flow rate.

It is a principle advantage of the present invention to control the amount of fuel discharged from the injector as a function of the fuel pressure in order that for a given electrical control signal the amount of fuel discharged will be constant.

To accomplish the above advantages of utilizing variable pressure, the core member and the limit pin are altered appropriately as shown in the drawings in which.

DETAILED DESCRIPTION

Figure 1:
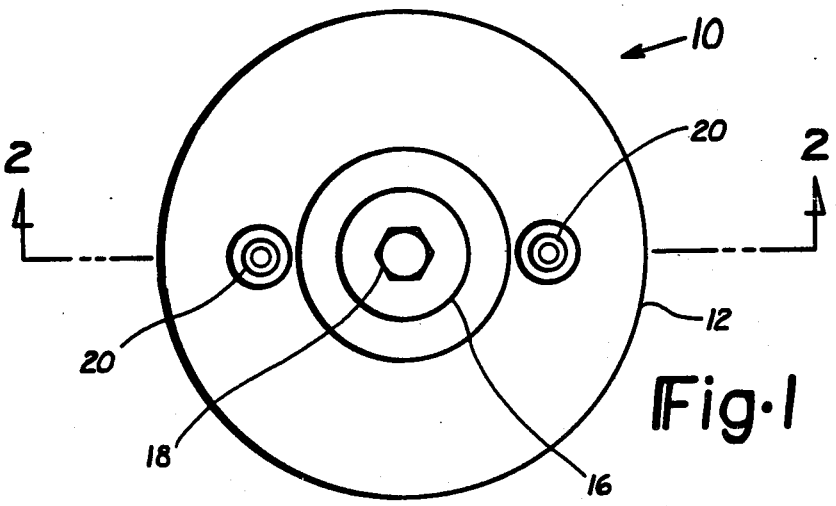
FIG. 1 is a plan view of an injector.

Referring to the FIGS. by the reference characters, there is illustrated in FIG. 1 a plan view of an injector 10 that may be used in single point fuel injection systems. The housing 12 has a centrally located aperture 14 from which the tube 16 and an adjusting means 18 extends. Spaced from the tube are a pair of contact terminals 20 which are electrically connected to a solenoid coil 22.

Figure 2:
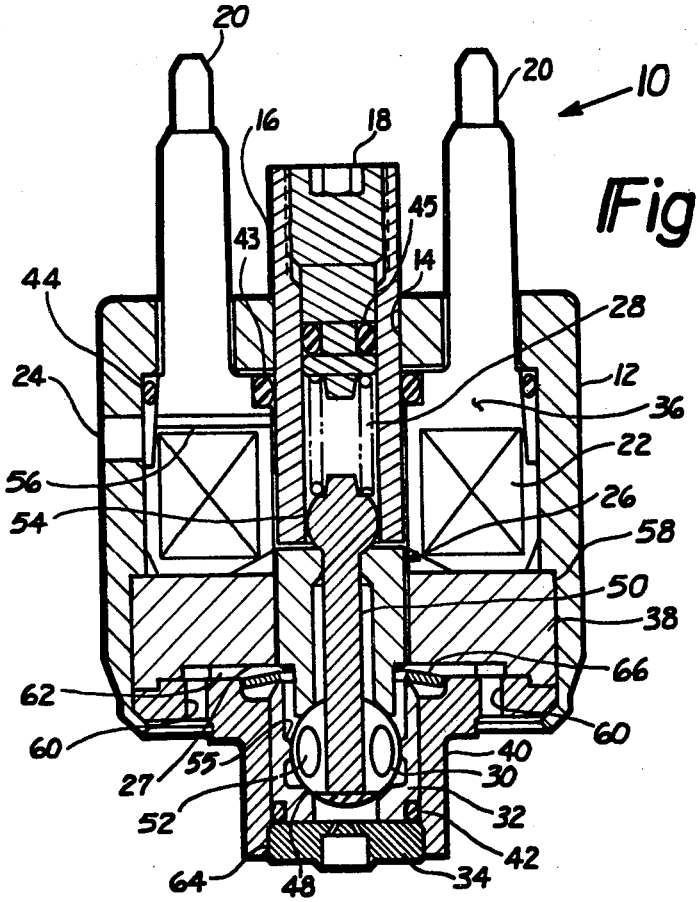
FIG. 2 is a cross-sectional view along a longitudinal line 2—2 of FIG. 1.

FIG. 2 is a cross-sectional view of the preferred embodiment of the injector 10 and is shown in a vertical orientation wherein fuel is supplied to the bottom of the injector 10 adjacent the valve end. This is typically called a "bottom-feed" injector. The same features of this injector 10, as described herein, are applicable to a "top feed" injector wherein fuel is supplied to the top end of the injector and flows through a central fuel passageway to the bottom or valve end of the injector.

The housing 12, as illustrated in FIG. 2, is a tubular member enclosed at one end. The housing 12 is molded from sintered iron or powdered metal and may be impregnated to prevent any fluid leakage or may be fabricated from a solid metal such as low carbon steel. The housing 12 has a vent aperture 24 extending through the wall for venting fuel, trapped air and vaporized fuel from the upper portion of the injector 10. Typically the vent 24 is connected to the fuel return line which is at a pressure which is lower than the pressure of the fuel supplied to the injector 10.

The several elements of the injector, as illustrated in FIG. 2, are the tube member 16, the adjusting means 18, the armature means 26, a bias spring 28, the valve member means 30, the valve seat member 32, a spray tip member 34, a solenoid coil assembly 36, a pole piece member 38, a plate member 40 and several sealing members 42–45.

In the preferred embodiment many of the elements are molded with sintered iron or powdered metal. These elements, when the molding process is completed, may not require any primary or secondary machining operations prior to assembly. As indicated the housing 12 is molded from sintered iron as are the pole piece 38, the plate member 40 and the armature member 27.

The tube member 16 which is a tubular stationary member in the injector 10 is inserted into the aperture 14 of the housing 12 and once positioned, after the remaining elements are in place, is staked to the housing 12 by a ring staking operation or other fastening means. In prior art injectors, the tube 16 is threaded into the housing 12 and used to adjust for static flow adjustments, however as will be hereinafter illustrated, the spray tip member 34 is used for this function.

Located in the tube member 16 at one end, the end external to the housing member 12, is an adjusting means 18 which is threaded into the inner diameter of the tube member 16 and extends axially into the tube member 16. At the opposite end of the tube member 16 and affixed either thereto or to the armature means 26, is a thin washer member, not shown, to provide for a minimum fixed magnetic gap between the tube member 16 and the armature means 26.

The armature means 26 comprises a valve member means 30 which is secured to an armature member 27 either by projection welding or similar means of fastening. The valve member means 30 may be a ball valve as illustrated having a spherical sealing surface mating with a conical valve seat 48. As illustrated, the ball valve 30 may be secured to an armature member 27 by means of a pin 50 secured to the ball and extending axially through the armature member 27.

The ball valve 30, if it is a full sphere, has a plurality of flats 52 thereon to allow fuel to flow around the ball as will hereinafter be explained. The pin 50 is secured to the ball through an axially extending aperture and headed on the ball. On the opposite end of the pin 50 on the outside of the armature member 27, is an enlarged spherical bearing 54 which is located in a sliding relationship to the inner diameter of the tube member 16. The distance between the spherical bearing 54 and ball valve is such to maintain the ball valve in contact with the armature member 27 so as to move as an integral unit forming the armature means 26. If the ball valve is welded to the armature member 27, the pin 50 may not extend through the ball but will guide the armature means 26 when the solenoid coil assembly 36 is energized and the armature means 26 is magnetically attracted to the tube member 16. In either embodiment, the spherical bearing 54 slides on the inner diameter of the tube member 16.

Interposed the spherical bearing 54 end of the pin 50 and the adjusting member 18, in the inner diameter of the tubular core member 18, is a bias spring 28 which functions to apply a pressure holding the valve member 30 against the valve seat 48 in valve seat member 32. By means of the adjusting means 18, the operating length of the bias spring 28 is changed which changes the dynamic characteristics of the injector 10.

The valve seat member 32 functions to provide a valve seat 48 for the valve member and has either a plurality of guides 55 or a complete ring guide for locating and aligning the valve member 30 and the valve seat 48. The integration of the guide or guides 55 and the valve seat 48 in one unitary valve seat member 32 provides for required concentricity between the valve member 30 and the valve seat 48. If there are a plurality of spaced guides 55, then the ball member will not be required to have any flat surfaces 52 thereon to provide for the passage of fuel thereby, but if there is a ring guide, then a number of flats 52 must be provided on the ball for the passage of fuel to the valve seat 48.

The solenoid coil assembly 36 contains the several windings of the coil 22 which are terminated at two contact terminals 20. The electrical signal, for operating the injector, is supplied to the two contact terminals 20 to energize the coil 22 creating a magnetic field causing the armature means 26 to be attracted to the tube member 16 thus lifting the valve member 30 from the valve seat 32. In the preferred embodiment, the coil 22 is encapsulated in a material which is not affected by the fuel controlled by the injector. As illustrated in FIG. 2, the end of the solenoid coil assembly 36 having the contact terminals 20 is tapered to provide a volume for fuel, air or vapor to collect to be discharged from the vent 24. A small tubular passageway 56 extends from the volume through the solenoid housing to the inside surface thereof adjacent the tube member 16 to provide means for drawing any fuel, air or vapor from the interior of the injector.

In order to complete the magnetic circuit within the injector, a pole piece member 38 is positioned adjacent the solenoid coil assembly 36 and the armature means 26. The pole piece member 38 is located in a stepped diameter 58 of the housing 12 and additionally functions to hold the solenoid coil assembly 36 against the enclosed end of the housing 12.

A plate member 40 functions to retain the pole piece member 38 against the stepped diameter 58 and to provide a fuel inlet 60 to the injector 10. As the embodiment shown in FIG. 2 is a bottom feed injector, fuel flows through the inlet 60 formed in the plate member 40 to the passageway 62 between the pole piece member 38 and the plate member 40 then, to the interior of the valve seat member 32 by the flats 52 on the ball valve and on to the valve seat 48. The plate member 40 has a coaxially extending aperture which is terminated by a threaded means 64 for locating the spray tip member 34. In assembling the injector 10, the valve seat member 32 is biased by a spring washer 66 against the spray tip member 34 which is threadably secured in the plate member 40.

Several sealing members 42–45 are positioned within the injector 10 to function not only for preventing the flow of fuel to certain areas in the injector but also to function as guide members allowing controlled movement of the several elements. As shown in FIG. 2, there is a first sealing ring 42 between the plate member 40, the spray tip member 34 and the valve seat member 32 to prevent the leakage of fuel from the injector 10. A second sealing ring 43 is positioned between the solenoid coil assembly 36 and the housing 12 to prevent leakage of fuel toward the contact terminals 20. A third sealing ring 44 is positioned around the tube member 16 and located on the solenoid coil assembly 36 inner diameter to prevent leakage of fuel toward the contact terminals 20. A fourth sealing ring 45 is positioned between the adjusting means 18 and the inside surface of the tube member 16 to allow the adjusting means 18 to move and to prevent the leakage of fuel out of the tube member 16.

When the injector is used in a fuel bowl or in the air stream of a throttle body, the housing 12, the pole piece 38, the plate member 40, and the armature means 26 are molded from sintered iron. This allows the necessary passageways to be formed in the mold by cores and once the parts are molded, many of the secondary machining operations are eliminated. In top feed injectors the several elements of the injector which typically have fuel only on one side, the molded elements or parts are also fabricated from sintered iron and are impregnated to prevent any leakage through the sintered iron.

Returning back to FIG. 2, in the operation of the injector 10, an electrical signal is supplied to the contact terminals 20 of the solenoid coil assembly 36. Typically, the signal is in the form of pulse wherein the width or time length of the pulse represents a desired quantity of fuel to be discharged from the injector. Such a pulse is typically generated in an electronic control unit in response to various signals from the engine and the engine operator.

The signal, when applied to the contact terminals 20, generates a magnetic field from the solenoid coil 22 which operates to attract the armature means 26 to the tube member 16 thereby lifting the valve member 30 off the valve seat 48. Fuel then flows under pressure from the fuel entry inlet 60 in the plate member 40, through the passageway 62 between the plate member 40 and the pole piece member 38, through and around the spring washer 66, down the inner tubular passage of the valve seat member 30 by the flats 52 on valve member 30 to the valve seat 48. Once the fuel leaves the valve seat 48, it is directed by the spray tip member 34 into an appropriate or desired spray pattern out of the injector 10.

When the electrical signal is removed or terminated, the bias spring 28 operates to force the armature means 26 away from the tube member 16 and the valve member 30 against the valve seat 48 effectively closing the injector.

The injector 10 is calibrated for its flow rate by energizing the solenoid coil 22 to lift the ball valve member 30 from the valve seat 48. The spray tip member 34 is then threadably adjusted to allow the valve seat member 32 to move axially under the biasing of the spring washer 66. This movement either opens or closes the volume between the valve member 30 and the valve seat 48. Typically once this adjustment is made, the spray tip member 34 is secured from further movement.

As previously indicated, the dynamic characteristics of the injector are adjusted by means of the adjusting means 18 which operates against the bias spring 28 to apply a spring force against the armature means 26. The heavier the force the longer the opening time and the shorter the closing time.

Figure 3:
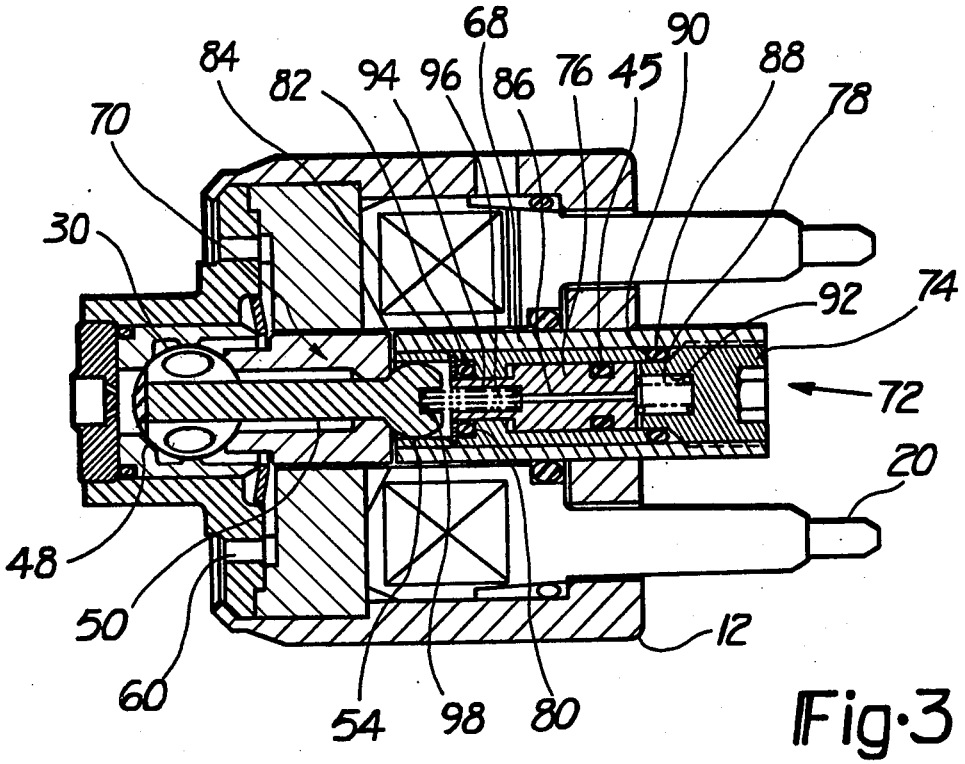
FIG. 3 is a longitudinal cross-sectional view of another embodiment of an injector.

Referring to FIG. 3, there is illustrated a modification of the injector 10 illustrated in FIG. 2. The modification is primarily in the tube member 68, armature means 70 and the adjusting means 72. In FIG. 3 the adjusting means is divided into two separate members namely a threaded adjusting member 74 and a cylindrical "T" shaped movable limit pin 76 separated by an adjusting spring 78.

The tube member 68 is modified to provide an internal step 80 interposed the ends of the tube member 68. On the side of the step 80 adjacent the armature means 70 is a fifth sealing ring 82 which may be trapped from axial movement by a retaining ring 84 secured in the inner diameter of the tube member 68. The purpose of the fifth sealing member 82 is to prevent fuel leakage along the limit pin 76 toward the threaded adjusting member 74 and to guide the limit pin 76 in its movement as will hereinafter be explained.

The limit pin 76 is a "T" shaped cylindrical member having a small passageway 86 extending between both ends. The cross-sectional area of the leg of the limit pin 76 is less than the cross-sectional area of the head of limit pin 76. The two diameters of the limit pin 76 and the diameter of the passageway 86 are controlled to provide a pressure compensated variable lift armature as will hereinafter be explained. The fourth sealing member 45 is secured in an annular groove on the limit pin 76.

The threaded adjusting member 74 is threaded into the tube member 68 and has a sixth sealing ring 88 positioned around an inner diameter of the adjusting member. The sixth sealing ring 88 functions to prevent fuel leakage out of the end of tube member 68. As the threaded adjusting member 74 is threaded into the tube member 68, the sixth sealing ring 88 is compressed between a second step 90 in the tube member 68 and the threaded adjusting member 74 to effectuate the sealing function. The threaded adjusting member 74 has an enclosed receptacle 92 extending inwardly from the surface adjacent the limit pin 76. An adjusting spring member 78 is located therein for biasing the limit pin 76 away from the threaded adjusting member 74.

The limit pin 76 contains a stepped bore wherein the large diameter bore 94 provides a receptacle for one end of the limit spring 96. The spherical bearing 54 end of the armature pin 50 contains a similar sized bore 98 as the large diameter thereby providing a similar receptacle for the other end of the limit spring 96 extending from the flat surface which is opposite the end of the tube member 68. The limit spring 96 operates to hold the valve member 30 against the valve seat 48. The smaller diameter of the stepped bore provides a flow passageway 86 for fuel to flow from the entry inlet 60 to the end of the head of the limit pin 76. A vent passageway, not shown, extends from the volume between the step 80 and the bottom of the head of the limit pin 76 to allow any fuel air or fuel vapor that leaks therein to pass out of the vent 24 in the housing 12.

With modification as shown in FIG. 3, the pressure of the fuel supply in part controls the operation of the injector in order that for a given pulse width electrical signal, the amount of fuel flowing from the injector is always the same. This is more particularly important when the fuel supply is LPG as the pressure of the fuel in its liquified state may be approximately 100 to 150 psi. By means of the flow passageway 86 through the limit pin 76, fluid flows into the chamber between the end of the head of the limit pin 76 and the threaded adjusting member 74 and bears against the cross-sectional area A1 which is the area of the end of the head of the limit pin 76 less the area of flow passageway 86. The cooperation between the force applied to the head of the limit pin 76 from the pressure of the fluid and the adjusting spring 92 and the bias force of the limit spring 96 acting on the bottom of the head of the limit pin 76 in the spring receptacle 94 plus the force created by the pressure of the fuel acting on the cross-sectional area of the end of the leg of the "T" shaped limit pin 76 less the area of the flow passageway 86, which is area A2, will adjust the force applied to the valve member 30 by the limit spring 96.

The fluid may be directed to the head of the limit pin 76 by means of the internal passageway 86 or by an external connection. When the fluid is supplied at a given pressure, the spring force necessary to dynamically close the valve member 30 on the valve seat 48 is adjusted by the threaded adjusting member 74 operating to move the limit pin 76 relative to the tube member 68 hence changing the spring force of the limit spring 96 to change the pressure of the valve member 30 against the valve seat 48.

When the pressure of the fluid increases, the limit pin 76 is moved closer to the armature means 70 causing the limit spring 96 to decrease in length thereby increasing the spring pressure. In a similar manner, the decrease of fluid pressure moves the limit pin 76 away from the armature means 70 causing the spring force to decrease. This is a variable pressure correction which supplements the dynamic adjustment of the injector.

Figure 5:
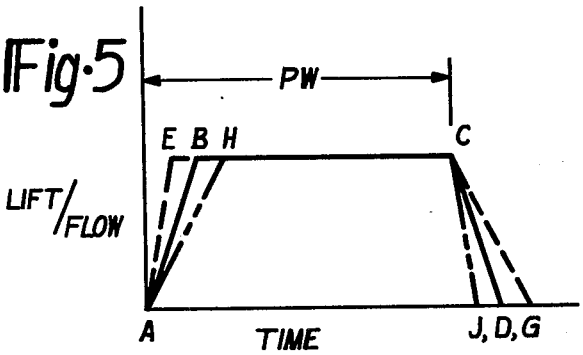
FIG. 5 is a graphic representation of fluid flow for a given pulse width at different fuel pressure levels to maintain constant fluid flow output through a constant valve member gap at various gap pressures.

The operation of the injector of FIG. 3 is graphically explained in FIG. 5 wherein fuel flow or valve lift along the abscissa axis is plotted against time along the ordinate axis. A standard pulse width, PW, is applied to the injector coil terminals 20 to energize the coil 22. With the fuel pressure at some nominal predetermined value, the movement of the valve member 30 from the valve seat 48 will follow the curve ABCD. The horizontal line BC represents the maximum opening or lift of the valve member 30 from the valve seat 48 and is determined by the armature means 70 limiting against the tube member 68.

The line AB represents the opening time of valve member 30 and the line CD represents the closing time of the valve member. The opening time is a function of the magnetic force of the coil 22 acting against the force of the limit spring 96. The closing time is a function of the decay of the magnetic field and the force of limit spring 96 returning the valve member 30 to the valve seat 48.

If the pressure of the fuel is increased from the aforementioned nominal predetermined value, the limit pin 76 will be moved toward the valve member 30 and the limit spring 96 will be compressed. The compression of the limit spring 96 causes a greater force to be applied against the valve member 30 and consequently the opening time of the valve member will be longer as illustrated by line AH in FIG. 5. With the heavier force from the limit spring 96, the valve member 30 will close quicker when the solenoid coil 22 is deenergized as is illustrated by line CJ in FIG. 5. However with higher fuel pressure, the amount of fuel discharged from the injector remains the same for the standard pulse width electrical signal PW.

In a similar manner if the pressure of the fuel is decreased from the previously mentioned nominal predetermined value, the limit pin will 76 be moved away from the armature means 70 and the limit spring 96 will be extended thereby reducing the force of the limit spring 96 against the armature means 70. This weaker force against the armature means 70 consequently causes the opening time of the valve member 80 to be shorter as illustrated by line AE in FIG. 5. However, the closing time of valve member is extended as illustrated by line CG.

In each of the examples in FIG. 5, the quantity of fuel which is discharged from the injector is the same because the flow of fuel varies directly with the pressure of the fuel. The higher the pressure, the more fuel that flows in a given amount of time. Since the exit volume of the injector, when fully opened is the same, the amount of time that the volume is opened must be varied if the amount of fuel leaving the injector is to be controlled. By using the pressure of the fuel to adjust the force length of the limit spring 96, the time of opening and closing of the valve member 30 is modified.

Figure 4:
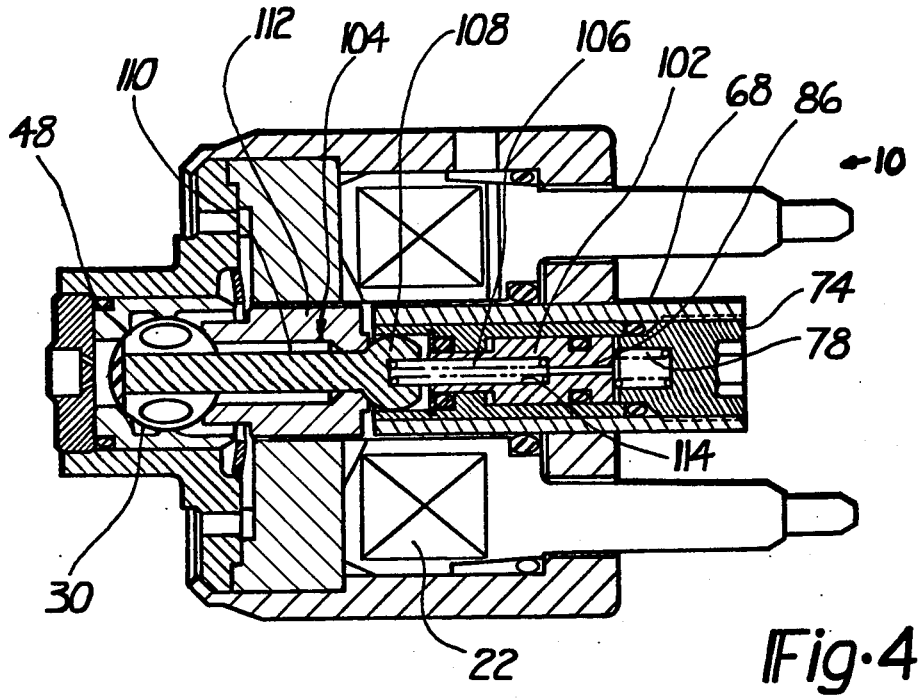
FIG. 4 is a longitudinal cross-sectional view of still another embodiment of an injector.

FIG. 4 is another modification of the injector of FIG. 1 and particularly differs from FIG. 3 in the structure of the limit pin 102 and the armature means 104 and the characteristic of the limit spring 106. The injectors of FIG. 2 and FIG. 3 are so structured that the armature means is attracted to the tube member and is limited in its axial movement by the tube member. Stated another way, the control gap in each of these two injectors is between the armature means and the tube member.

In FIG. 4, the control gap is between the spherical bearing 108 end of the pin 110 of the armature means 104 and the limit pin 102. The armature member 112 is undercut at the surface adjacent the tube member 68 in order to prevent armature member from abutting against the tube member 68 when the solenoid coil 22 is energized. The limit pin 102 in FIG. 4 is lengthened as compared to the limit pin 76 in FIG. 3 so as to provide a stop for the armature means 104. With this change in structure coupled with the appropriate charge in the force of the limit spring 106, the injector now becomes a variable lift injector. The balance of the forces on the two end surfaces of the limit pin 102 due to the fuel pressure and the forces created by the limit spring 106 and the adjustment spring 78, will position the limit pin 102 to control the "lift" of the armature.

As in FIG. 3, fuel enters the injector and flows into the limit spring cavity 114, through the small flow passageway 86 in the limit pin 102 to the chamber between the limit pin 102 and the threaded adjusting member 74. With no other forces present, the force created by the pressure of the fuel acting on the surface A1 is greater than the force of the fuel acting on the surface A2 thereby tending to move the limit pin 120 toward the threaded adjusting member 74. The adjusting spring 78 provides a force resisting the movement and in fact creates a force to keep the limit pin 102 spaced from the threaded adjusting member 74 and the force created by the limit spring 106 balances the forces to place the limit pin 102 in a predetermined standard or fixed position at a nominal pressure. If the fuel pressure increases, the limit pin 102 will be moved toward the armature means 104 and conversely if the pressure decreases the limit pin 102 will be moved toward the threaded adjusting member 74.

Figure 6:
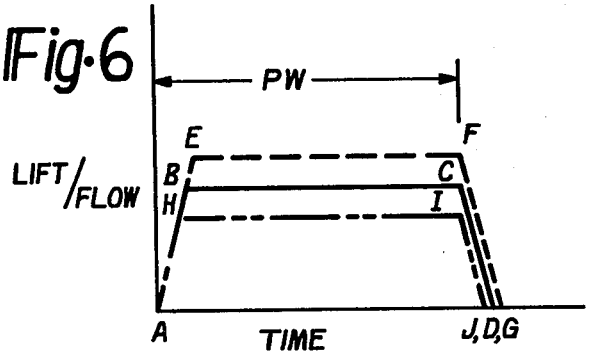
FIG. 6 is a graphic representation of fluid flow for a given pulse width at different fuel pressure levels to maintain constant fluid flow output through various valve member gaps.
Figure 7:
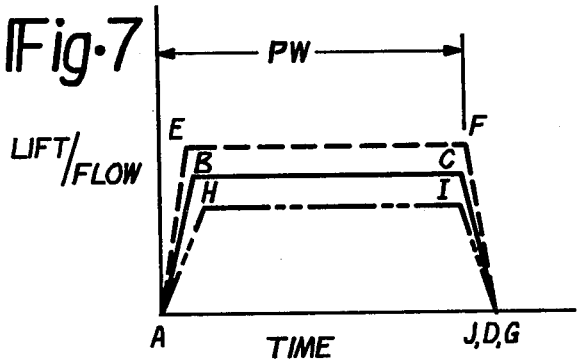
FIG. 7 is a graphic representation of fluid flow for a given pulse width at different fuel pressure levels to maintain a constant fluid flow output with variable gap pressures and variable valve member gaps.

Referring to FIG. 6, the operation of the injector of FIG. 4 is graphically represented. Under the nominal pressure, the opening and closing of the injector and the amount of lift is illustrated by curve ABCD. The ordinate of the curves in FIGS. 5, 6 and 7 is measured in time and the abscissa is measured in lift of the valve member 30 or armature means 104 or the flow of fuel. Thus, in FIG. 6, the curve AEFG represents the effect of variable lift when the pressure of the fuel is below the normal pressure and curve AHIJ represents the effect of variable lift when the pressure of the fuel is greater than the nominal pressure. In each instance, the slopes of the opening and closing curves are substantially identical.

Combining the variable pressure feature with the variable lift feature in a single injector, the structure will be very similar to that shown in FIG. 4 with the operation graphically represented in FIG. 7. Structurally the limit spring 106 and the adjusting springs 78 will be sized different than for either feature above. In the combination injector as the pressure of the fuel varies the lift of the armature means 104 and the pressure holding the valve member 30 against the valve seat 48 varies. Again, for the injector at a predetermined nominal fuel pressure the lift or flow curve plotted against time is ABCD in FIG. 7. If the pressure increases, the opening and closing times change as does the amount of lift so that the curve AHIJ represents a fuel pressure greater than the nominal pressure. This illustrates that the lift is slightly less than normal and probably less than under the conditions which created FIG. 6. The slope of the opening curve AH in FIG. 7 is steeper than the slope of the opening curve AH in FIG. 5 because the spring values are different and likewise the slope of the closing curve IJ in FIG. 7 is not as steep as the closing curve CJ in FIG. 5. If the pressure decreases, the opening and closing times change as does the amount of lift so that the curve AEFG represents a fuel pressure greater than the nominal pressure. This illustrates that the lift is slightly greater than normal and probably less than under the conditions which created FIG. 6. The slope of the opening curve AE in FIG. 7 is steeper than the slope of the opening curve AE in FIG. 5 because the spring values are different and likewise the slope of the closing curve FG in FIG. 7 is steeper than the closing curve CG in FIG. 5.

Figure 8:
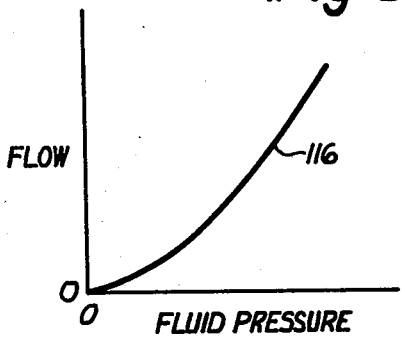
FIG. 8 is a graphic representation of fluid flow for a given pulse width and valve member gap at different fuel pressures in prior art injectors.

In FIG. 8 there is graphically illustrated the operation of prior art injectors which are not adaptable to be compensated for fuel pressure variations. In this FIG. 8 the pulse width of the electrical signal to the injector and the gap or the volume between the valve member and the valve seat is held constant. Therefore as fuel pressure increases, the amount of fuel flowing from the injector will follow a curve, which here is represented by a curve line 116 but in practice could be any other shape but in no event would the curve be parallel to the abscissa of the graph.

Figure 9:
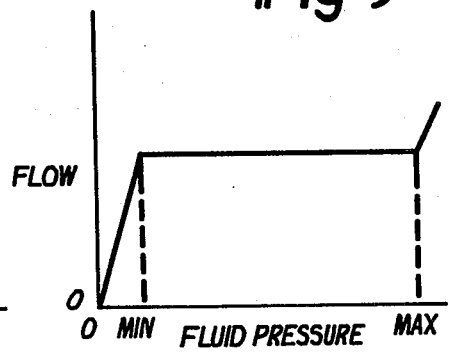
FIG. 9 is a graphic representation of fluid flow in an injector made according to the invention herein.

FIG. 9 is a graphic representation of an injector modified to be adaptable to variations in fuel pressure be it variable pressure modification as illustrated in FIG. 5; variable lift modifications as illustrated in FIG. 6; or variable lift/pressure modifications as illustrated in FIG. 7. FIG. 9 illustrates that the amount of fuel flowing from the injector is constant from a certain minimum pressure below the expected fuel pressure range to a certain maximum pressure above the expected fuel pressure range.

In all the curves of FIGS. 5–9, the curves are illustrated as straight lines for an ease of representation. It is understood that due to various configurations and flow paths within the injector, such curves may not be straight but will behave in the general characteristic of those shown. In addition throughout whenever the word fuel is used, the word fluid may be substituted therefore.

There has thus been shown and described a fuel injector which is fabricated according to powdered or sintered metal technology and is modified to respond to variations in fuel pressure to maintain the flow output from the injector constant for a given pulse width regardless of the pressure of fuel.

I claim:

1. A pressure compensated fuel injector having a tubular housing member enclosed at one end containing a solenoid coil assembly for generating a magnetic field, a tube member extending through an aperture in the enclosed end, an adjustment means threaded in the tube member, an armature means adapted to be magnetically attracted to the tube member and having a spherical bearing connected thereto for locating and guiding in the tube member as the armature means moves under control of the magnetic field, valve seat means, valve member means responsive to the armature means for moving relative to the valve seat means, and means at the open end of the tubular housing member for receiving pressurized fuel into the injector for discharge between the valve member means and the valve seat means under control of the magnetic field, the injector characterized by:

the armature means being spaced from the tube member for forming a control gap therebetween;

the adjustment means additionally includes a tubular "T" shaped limit pin wherein the cross sectional area of the end of the head of said pin is greater than the cross sectional area of the end of the leg of said limit pin, said limit pin being movable within the tube member and interposed a threaded adjusting member and the spherical bearing of the armature means;

means for conducting fuel from the fuel receiving means to said end of said leg of said limit pin;

a limit spring connected between said limit pin and the spherical bearing;

a flow passageway through said limit pin from said end of said leg thereof to said end of said head thereof, said passageway operable to conduct fuel from the leg to said head of said limit pin;

said limit pin being movable to a plurality of positions for varying the force applied by said limit spring to the armature means in response to the change in the force applied by the pressure of the fuel against the cross sectional areas of said end of said leg and said end of said head of said pin so that the force holding the valve member means against the valve seat means varies in direct proportion to changes in the pressure of the fuel with said control gap remaining fixed.

2. The pressure compensated injector as defined in claim 1 additionally including a sealing means positioned around said leg and said head of said pin presenting the flow of fuel therebetween.

3. A pressure compensated fuel injector having a tubular housing member enclosed at one end containing a solenoid coil assembly for generating a magnetic field, a tube member extending through an aperture in the enclosed end, an adjustment means threaded in the tube member, an armature means adapted to be magnetically attracted to the tube member and having a spherical bearing connected thereto for locating and guiding in the tube member as the armature means moves under control of the magnetic field, valve seat means, valve member means responsive to the armature means for moving relative to the valve seat means, and means at the open end of the tubular housing member for receiving pressurized fuel into the injector for discharge between the valve member means and the valve seat means under control of the magnetic field, the injector characterized by:

the adjustment means additionally includes a tubular "T" shaped limit pin wherein the cross sectional area of the end of the head of said pin is greater than the cross sectional area of the end of the leg of said limit pin, said limit pin being movable within the tube member and interposed a threaded adjusting member and the spherical bearing of the armature means;

the spherical bearing being spaced from said limit pin for forming a control gap therebetween defining the lift between the valve member means and the valve seat means;

means for conducting fuel from the fuel receiving means to said end of said leg of said limit pin;

a limit spring connected between said limit pin and the spherical bearing;

a flow passageway through said limit pin from said end of said leg thereof to said end of said head thereof, said passageway operable to conduct fuel from the leg to said head of said limit pin;

said limit pin being movable to a plurality of positions for varying the said control gap between said end of said limit pin and the spherical bearing member in response to the change in the force applied by the pressure of the fuel against the cross-sectional areas of said end of said leg and said end of said head of said limit pin so that said position of said limit pin changes said control gap so that said lift between the valve member means and the valve seat means varies in proportion to changes in the pressure of the fuel.

4. The pressure compensated injector as defined in claim 3 wherein the spherical bearing has a flat end surface opposite the end of the tube.

* * * * *